US005961762A

United States Patent [19]

Zelinka et al.

[11] Patent Number: 5,961,762

[45] Date of Patent: Oct. 5, 1999

[54] METHOD AND ASSEMBLY FOR MANUFACTURING ACOUSTIC TRANSDUCERS

[75] Inventors: Thomas Zelinka; Jim Balcom, both of Vancouver; Scott Phillips, Victoria; Gary Cook; Mohammad Kermani, both of Vancouver; Paul Taylor, Sidney, all of Canada

[73] Assignee: Sonigistix Corporation, Richmond, Canada

[21] Appl. No.: 09/069,148

[22] Filed: Apr. 29, 1998

[51] Int. Cl.[6] ..... H04R 31/00

[52] U.S. Cl. ..... 156/164; 29/594; 156/160; 156/229; 156/267; 156/275.5; 156/275.7; 156/495; 156/496; 156/522; 387/398

[58] Field of Search ..... 156/160, 163, 156/229, 267, 164, 250, 251, 494, 495, 496, 510, 522, 275.5, 275.7; 29/594; 381/398

[56] References Cited

U.S. PATENT DOCUMENTS

| | | | |
|---|---|---|---|
| 3,596,733 | 8/1971 | Bertagni | 156/229 |
| 4,316,062 | 2/1982 | Beveridge | 29/594 |
| 4,568,414 | 2/1986 | Oldis et al. | 156/160 |
| 4,803,733 | 2/1989 | Carver et al. | 29/594 X |
| 5,205,897 | 4/1993 | Nonaka | 29/594 |
| 5,850,461 | 12/1998 | Zelinka | 381/398 |

*Primary Examiner*—Jeff H. Aftergut

*Attorney, Agent, or Firm*—Dowell & Dowell, P.C.

[57] ABSTRACT

A method and apparatus for high speed and uniform manufacture and assembly of acoustical diaphragms having electrical conductor circuits applied thereto to frame components used with acoustic transducers wherein a web of diaphragm material having a plurality of spaced circuit carrying diaphragm sections applied thereto is moved relative to an applicator station wherein each section of the web of diaphragm material is placed under a predetermined tension and a frame component is bonded to the tensioned section, afterwhich the section of diaphragm material is severed from the web of diaphragm material.

36 Claims, 5 Drawing Sheets

METHOD AND ASSEMBLY FOR MANUFACTURING ACOUSTIC TRANSDUCERS

BACKGROUND OF THE INVENTION

The present invention is directed to the manufacturing of acoustical transducers and, more specifically, to the methods and devices for assembling diaphragms to support frames which are utilized in transducers such as planar magnetic transducers. In accordance with the invention, electrical conductors are applied to the diaphragm material after which the material is conveyed to an applicator station having a bonding and cutting assembly which is operable to secure properly tensioned sections of the diaphragm material to the frames.

Conventionally, planar magnetic speakers or planar magnetic transducers have been manufactured in relatively small volumes for select market applications requiring largely manual assembly processes. Not only is the manual assembly of such transducers inefficient and not cost effective but the operating performance of the end products can not be uniformly maintained. Variation of performance results from a number of factors associated with the assembly procedures including the non-uniform tensioning of transducer diaphragms.

In the field of planar magnetic transducers, it is important that diaphragm responses are uniformly predictable. To optimize performance levels over a wide acoustical range, the tension of the diaphragms and electrical conductors mounted thereon must be maintained within predetermined ranges.

In U.S. Pat. No. 4,803,733 to Carver, the tensioning of a diaphragm of a planar magnetic transducer or speaker is disclosed wherein the diaphragm, having an electrical conductor circuit applied thereto, is initially secured under little or no tension to one half of a diaphragm supporting frame. The frame includes a tensioning groove in which segments of the outer edges of the diaphragm are urged by tensioning members either disposed between opposing frame members or extending from one of the opposing frame members. In U.S. patent application Ser. No. 08/943,272 filed Oct. 3, 1997, now U.S. Pat. No. 5,850,461 in the name of Thomas Zelinka, assigned to the Assignee of the present invention, an improvement over the tensioning groove structure disclosed in the patent to Carver is disclosed which provides for a selective tensioning of diaphragms relative to different portions of the transducer frame such that tensioning may be adjusted and varied across the surface of a diaphragm.

In U.S. Pat. No. 3,939,312, a method of assembling speaker diaphragms is disclosed wherein the diaphragms are applied to frames and thereafter heat is applied to shrink the diaphragms. Unfortunately, with this process, it is necessary to apply heat to the electrical conductors mounted to the diaphragms which can result in damage to the conductors and, further, tensioning by heat shrinkage is not uniform from one diaphragm to another and there is also no control over how the tension may be varied along different axes of the diaphragms.

In view of the foregoing, there is a need to develop processes and machinery for high speed assembly of acoustic diaphragms and support frames in such a manner as to uniformly provide predetermined tensioning of the diaphragms and thus predictable acoustic response to an end product transducer.

SUMMARY OF THE INVENTION

The present invention is directed to a method and apparatus for the high speed and uniform manufacture and assembly of transducer diaphragms and diaphragm support frames for use in transducers such as planar magnetic transducers. In accordance with the methodology of the invention, a process for securing flexible acoustic diaphragms to the frames is disclosed wherein a diaphragm material is initially treated so as to apply a plurality of spaced conductor patterns or circuits thereto with each circuit being configured for a separate transducer. After the electrical conductors have been applied to the diaphragm material, the material is preferably rolled about a dispensing reel in such a manner that the electrical conductors are not adversely affected during the winding process.

The diaphragm material is conveyed as a web from the dispensing reel by an appropriate drive mechanism such as an indexing mechanism or collection reel. During conveyance of the diaphragm material, the material is, in some embodiments, aligned and tensioned longitudinally generally parallel to the elongated axis thereof before entering an applicator station wherein separate transducer sections are tensioned appropriately, aligned with and bonded to support frame components.

As the web of diaphragm material is indexed relative to the applicator station, a frame component is aligned relative to the material and, in some embodiments, sensors are utilized to assure proper alignment of the separate diaphragm sections having the conductor circuits applied thereto relative to an adjacent frame component. Thereafter, or during this process, tension is applied with respect to a longitudinal axis of the aligned section of web material utilizing a tensioning assembly.

Once the appropriate tension is applied to a section of the diaphragm material, the diaphragm section and the frame component are urged into contact with one another. In the preferred embodiment, an ultraviolet (UV) curable adhesive material is pre-applied to the perimeter of the frame component prior to being positioned within the applicator station. Pressure is retained to secure the diaphragm section to the frame component until the adhesive is activated and set using an UV light source so that the diaphragm section is securely bonded thereto. Thereafter or simultaneous with the bonding step, a cutter is used to sever the diaphragm section from the continuous web of diaphragm material. The waste or excess diaphragm material is thereafter urged from the applicator station and wound about the collection reel or otherwise collected. The frame component having the diaphragm section securely bonded thereto is removed from the applicator station and a new frame component positioned therein.

The present invention contemplates a number of alternative tensioning mechanisms which may be utilized in the process and assembly of the diaphragm materials and the support frame components. In a first embodiment, opposing gripper tensioning members are utilized to apply final tension transversely with respect to the elongated axis of the diaphragm material within the applicator station. The pair of gripper members are mounted along opposite edges of the diaphragm material and are activated by appropriate means such as pneumatic or hydraulic pinch cylinders. Upon activation, the gripper members grasp the opposite edges of the diaphragm material after which the gripper members are moved outwardly relative to one another so as to apply a predetermined tension transversely with respect to the elongated axis of the material. In some embodiments, a single pair of gripper members may be moved relative to a fixed pair of gripper members as opposed to movement of both pairs of gripper members relative to one another. After final tension is achieved, an aligned support frame component is pressed into engagement with the diaphragm section and the UV light source activated.

In a variation to the first embodiment, the opposing gripper tensioning members may be formed as a tenter assembly including a plurality of opposing clamps which are mounted to a guide track or conveyor mechanism in spaced relationship with respect to one another. The conveyor mechanism is mounted so as to diverge from the central axis of the web of diaphragm material along its length. As the diaphragm material approaches the tenter assembly, at least one edge of the web is engaged by the spaced clamps. Thereafter, as the clamps move along the conveyor mechanism, they will pull the web of diaphragm material outwardly relative to the elongated central axis thereof. In a preferred embodiment, the tenter assembly includes conveyor mechanisms on both sides of the web of diaphragm material, each including a plurality of opposing clamping elements.

In a further variation of the first embodiment, opposing gripper members, rollers or other tensioning members may be aligned to engage the web of diaphragm material at a plurality of spaced areas surrounding a section of the diaphragm material. Using such a variation, predetermined tension may be applied in substantially any direction relative to the elongated axis of the web.

In accordance with an alternate embodiment of the present invention, final transverse as well as possibly other directional tensioning is achieved within the applicator section utilizing a vacuum tensioning assembly. The vacuum tensioning assembly includes a pair of open clamping frame members including a first frame member having a continuous peripheral vacuum channel or recess which is connected to a vacuum source. The other or second clamping member is designed to engage the first clamping member in surrounding relationship with respect to the vacuum channel formed therein. As the diaphragm material is clamped between the opposing clamping frame members, a vacuum is applied to the vacuum channel, thereby drawing portions of the diaphragm material into the vacuum channel until a predetermined tension is applied to a diaphragm section aligned within the opening defined by the clamping frame members. Thereafter, a frame support assembly is moved so as to urge a frame component into engagement with the diaphragm section retained within the clamping members and the frame component is retained in engagement with the tensioned diaphragm section until the diaphragm is secured to the frame component.

In yet a further embodiment of the present invention, a tensioning shoe or ram is utilized to mechanically deform each diaphragm section within the applicator station. In this embodiment, a pair of open frame clamps engage the web of diaphragm material along opposite edges and at opposite ends of each diaphragm section. With the material being gripped between the opposing frame clamps, a control element such as a pneumatic or hydraulic actuator is activated to depress a tensioning shoe which is preformed so as to engage substantially the entire area of the diaphragm section and deflect the diaphragm section until proper tensioning is achieved. Thereafter, a frame support is moved to engage a frame component with the tensioned diaphragm section and the frame component is retained against the diaphragm section which it is secured thereto.

By varying the configuration of the vacuum channel or the shoe member or the orientation and number of gripping members, the diaphragm material may be stretched and properly tensioned in substantially any direction relative to its elongated axis.

With the methodology of the present invention, it is possible to ensure that proper tension is placed upon each diaphragm section prior to being secured to a frame component such that, when secured to the frame component, the resulting tension is maintained within design parameters.

It is the primary object of the present invention to provide a process for assembling diaphragms used in acoustic transducers to support frame components wherein assembly time is decreased over prior art methodologies and wherein precise uniform tensioning of large web areas is achieved for purposes of assuring optimum acoustic performance of the diaphragms when in use. Further, it is an object of the present invention to provide a process which ensures that the tension placed on the diaphragms during the assembly process is repeatable and within the elastic limits determined for a particular diaphragm material.

It is yet a further object of the present invention to provide a process for assembling acoustical diaphragms to support frame components wherein the proper alignment between the electrical circuit patterns carried by the diaphragms and the frame components can be continuously and uniformly assured.

It is a further object of the present invention to provide a method and apparatus for the uniform and high speed assembly of electrical circuit carrying diaphragms to support frames utilizing an intermittent conveying process with bonding and cutting steps associated therewith and wherein tension may be applied multi-directionally relative to the elongated axis of the web of diaphragm material so that each diaphragm section is properly tensioned when bonded to a frame component.

It is also an object of the present invention to provide a method and apparatus for applying acoustic diaphragms to support frame components wherein adjustments may be made to the tension of the diaphragm material before being applied to the frame components to ensure proper tensioning depending upon electrical circuit and diaphragm material characteristics.

BRIEF DESCRIPTION OF THE DRAWINGS

A better understanding of the invention will be understood with reference to the attached drawing figures, wherein.

DESCRIPTION OF THE PREFERRED EMBODIMENTS

Figure 6:
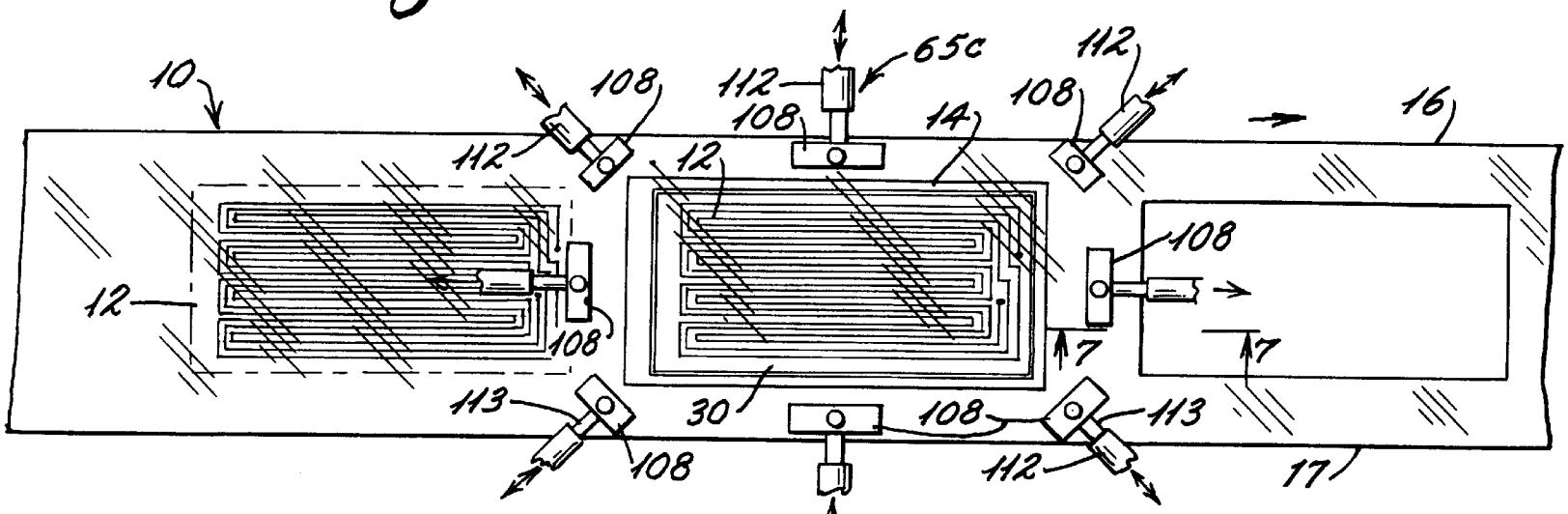
FIG. 6 is a top plan view of another variation of the first embodiment showing a multi-directional tensioning assembly in accordance with the present invention.

With continued reference to the drawing figures, a diaphragm material 10 suitable for use with acoustic transducers is shown having a plurality of electrical conductor patterns 12 applied thereto (see FIG. 6). The diaphragm material is preferably a thin polymer sheet which may be formed of a DuPont Mylar™ or Kapton™ film. As shown in the drawing figures, the conductor patterns are spaced at a distance which is predetermined based upon the size of transducer support frame component 14 to which the diaphragm material is to be secured. Each of the conductor patterns is shown including a plurality of generally longitudinal conductor segments which extend generally parallel to an elongated axis A—A of the diaphragm material with the patterns being generally centrally spaced between opposing edges 16 and 17 of the material. The conductor segments 12 are electrically connected to inputs and outputs 18 and 19 which are provided so as to be aligned with appropriate electrical contacts associated with the frame component 14.

Once the conductor patterns have been applied to the diaphragm material, the material is preferably wound about a core to form a dispensing roll 20 wherein the roll core has a diameter of a size so that the conductor runs are not adversely deformed. The width of the material will vary depending upon the size of the transducers to be produced.

Figure 13:
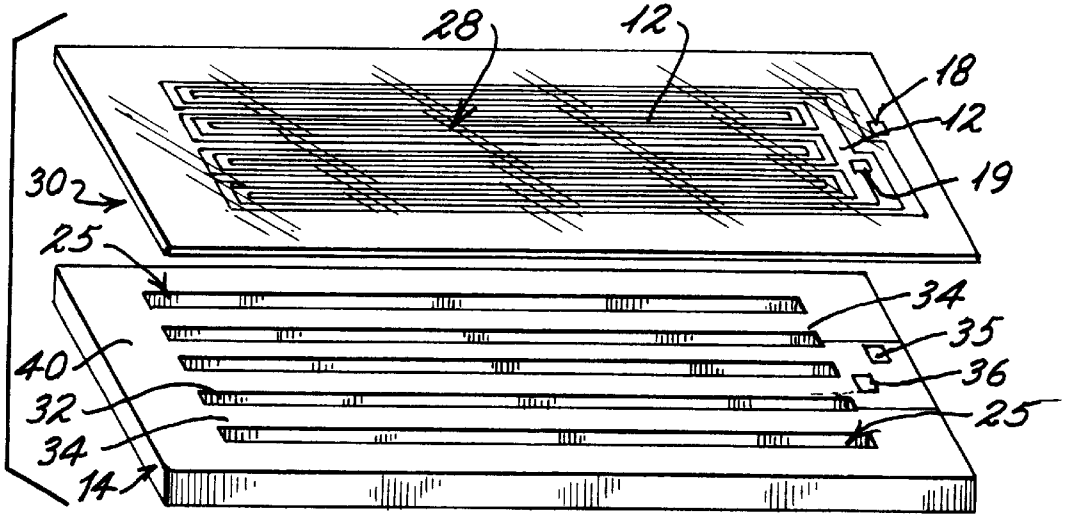
FIG. 13 is an assembly view showing a diaphragm section and a support frame component.

With specific reference to FIG. 13, the diaphragm support frame component 14 is shown in greater detail. A diaphragm frame includes opposing frame components, each of which defines an inner open area 25 for purposes of receiving the sound reproducing or active area 28 of a diaphragm section 30. A plurality of U-shaped channels 32 are secured so as to extend across the open area of each frame component and serve to receive permanent magnets 34, such as bar magnets. The configuration of the channels and the orientation of the magnets will depend upon the conductor pattern applied to the diaphragm material. When the frame components are assembled, the diaphragm is retained therebetween so as to be in spaced relationship with respect to the magnets and aligned so that the conductor patterns are properly aligned between opposing magnets. The frame configuration shown in the drawing figures is for example only.

It should be noted that, in some acoustical transducers, the diaphragm is mounted to a separate intermediate support frame which is thereafter mounted between more rigid frames which support the magnets utilized with the transducer assembly. In such instances, the present invention would be directed to securing the diaphragm to one of the opposing frame components associated with the intermediate frame member.

Also associated with frame component 14 are input and output contacts 35 and 36 which are designed to electrically contact the input and output 18 and 19 of the conductor pattern applied to the diaphragm material when the diaphragm material is secured to the frame component. The section of diaphragm material is initially secured to one of the frame components such as by adhesives or adhesive elements.

The necessary adhesive bond to secure the diaphragm must provide for a very high sheer strength. As the support frame components will eventually be riveted or otherwise connected to one another, there is little need for high peel strength. There are a number of adhesives and adhesive materials which may be utilized in accordance with the teachings of the present invention.

The diaphragms may be initially secured utilizing liquid adhesives which may be of the moisture cured, time cured, epoxies or UV cured adhesives which are applied, such as shown at 40, to the perimeter of frame component 14. As an alternative, adhesive tapes, such as a 3M VHB™ tape, could be utilized with a foam carrier and applied to the perimeter of the frame component. Alternatively, heat activated adhesive tapes or dry films which crosslink with heat may also be applied to the perimeter of the frame components. In some instances, where the frame is formed of a plastic material, ultrasonic welding may also be utilized as opposed to an adhesive to secure the diaphragm to the frame component.

Figure 1:
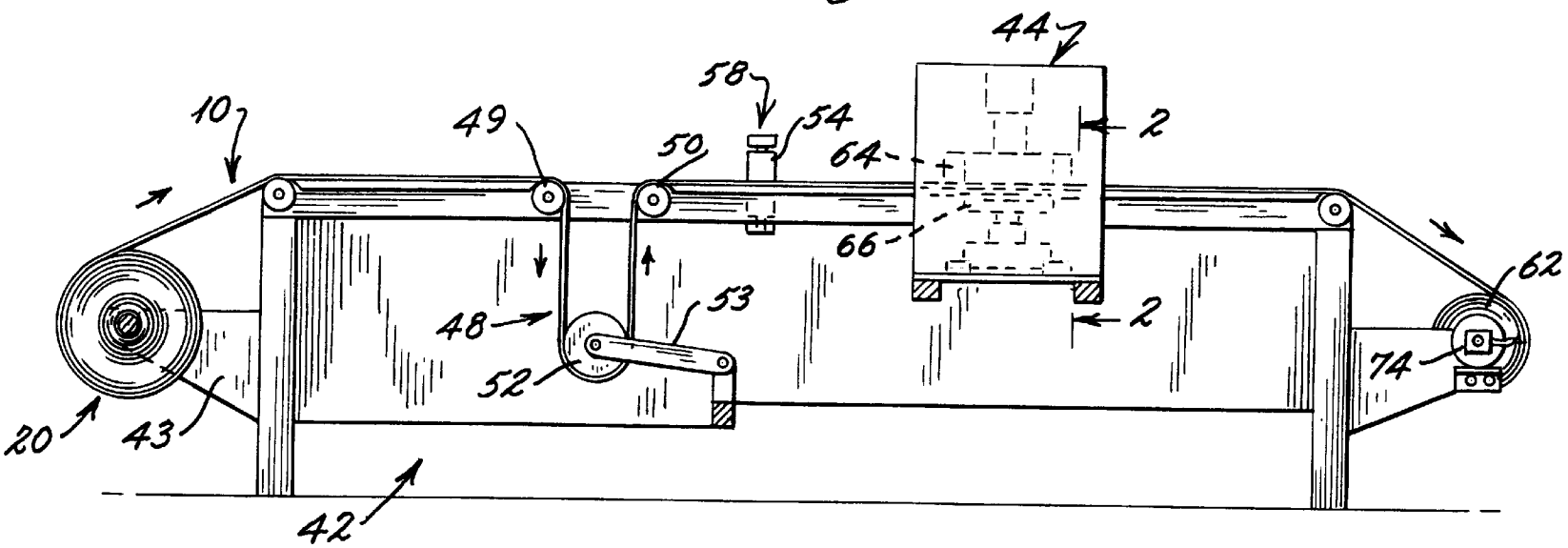
FIG. 1 is a schematic illustrational view of the processing assembly of the invention.

With particular reference to FIG. 1, an apparatus 42 for conveying the diaphragm material 10 to an applicator section 44 for bonding and severing a section 30 of the diaphragm material and securing it to a support frame component 14 is disclosed in greater detail. The conveying and application apparatus 42 includes a support 43 for the dispensing roll 20 of diaphragm material. As the diaphragm material 10 is pulled from the roll in the embodiment shown, it passes through an initial axial tensioning station 48. In the tensioning station 48, the diaphragm material passes about guide rollers 49 and 50 and is engaged by a tensioning roller 52 mounted on a pivot arm 53. The amount of axial tension to be initially applied to the diaphragm material may be predetermined and regulated by an adjustment mechanism (not shown) associated with the arm 53. Thereafter, the diaphragm material may extend between a pair of transverse alignment devices, such as opposing rollers 54, in a web steering station 58 which ensure that the edges of the diaphragm material are appropriately aligned to direct the material into the applicator station 44. Within the applicator station 44, the sections 30 of the diaphragm having the conductor patterns 12 applied thereto are aligned with the frame components 14 carried on a support, as shown more specifically in FIG. 2. When the sections 30 are being directly applied to frame components carrying the magnets 34, the conductor patterns must be properly oriented with respect to the magnets. Thereafter, the diaphragm sections are bonded and severed from the diaphragm material with the remaining portion of the diaphragm material being collected such as by winding on a collection reel or waste take-up reel 62.

Figure 2:
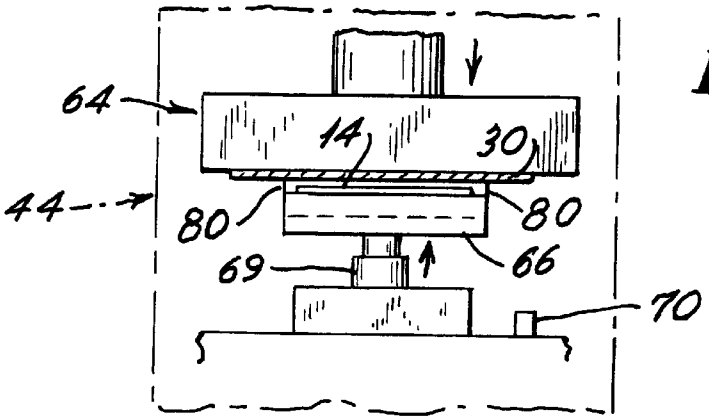
FIG. 2 is a view taken generally along line 2—2 of FIG. 1 of a diaphragm frame component support assembly showing a frame component supported relative to a web of diaphragm material being conveyed through the applicator station of the invention.

With continued reference to FIG. 2, the manner in which the support frame components are oriented with respect to the web of diaphragm material within the applicator station 44 is disclosed. The tensioning mechanism is shown generically at 64. The type of tensioning mechanism used in the present invention may vary as discussed herein. The tensioning mechanism associated with the applicator station is normally used to apply transverse tension to the diaphragm web 10 to a predetermined tension before a section 30 is secured to a frame component. In some embodiments, however, it may be sufficient to apply only axial tension to the section 30 of the web of diaphragm material. The frame components are held in a support 66 which is aligned or alignable with respect to a section of the web of diaphragm material within the applicator station. The support 66 is mounted on pneumatic or hydraulic cylinder 69 which is connected to a suitable source of fluid supply so as to enable the frame component carried by the support 66 to be brought into engagement with a section 30 of the diaphragm web after the section 30 has been properly tensioned.

To align a section 30 of the web of diaphragm material linearly within the applicator station, one or more sensors 70 are mounted to the machine frame. The sensor(s) are used to control the indexing take-up roller 62, or other indexing mechanism, when they detect that a diaphragm section 30 is properly aligned within the applicator station 44. By way of example, the sensor(s) may be mounted so as to detect when a conductor pattern is properly positioned to initiate final tensioning. The sensor may be an optical sensor having an output (not shown) connected to a drive motor 74 associated with the take-up roller 62.

Figure 3:
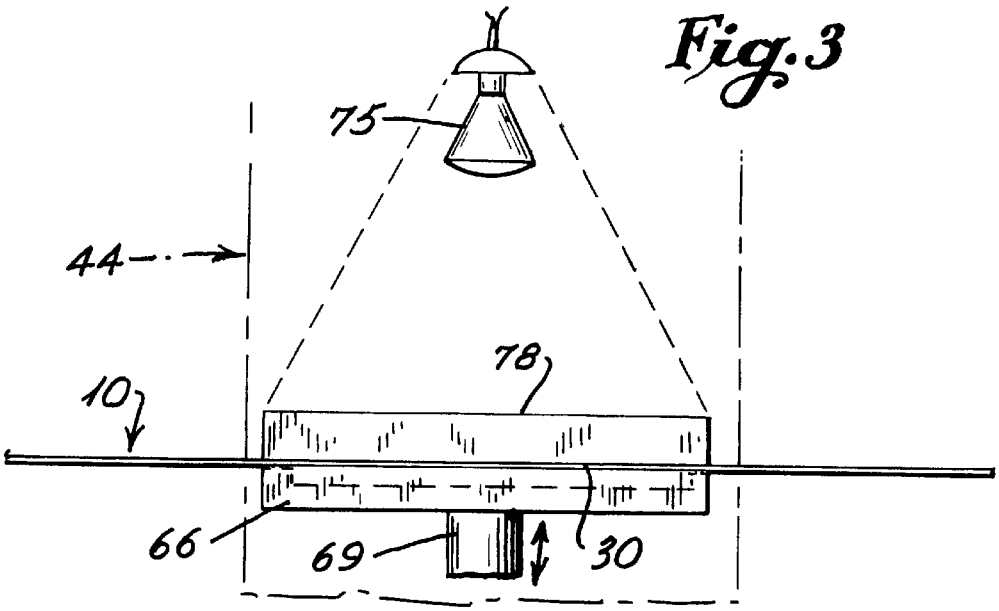
FIG. 3 is a view showing the frame support member incorporating an integral cutter for severing a section of the diaphragm material and also illustrating an UV light source for initiating the setting of an UV adhesive utilized to bond a diaphragm section to a frame component.

As previously discussed, in the preferred embodiment, an adhesive is applied to the periphery of the frame component prior to the frame component being placed on the support 66. When a section of the web of diaphragm material is properly aligned within the applicator station and the diaphragm web is tensioned, the cylinder 69 connected to the frame support 66 is activated to elevate the frame component against the tensioned diaphragm web section. With particular reference to FIG. 3, after the frame component engages the lower surface of the diaphragm web, an UV light source 75 is activated to initiate the adhesive and bond the diaphragm section 30 to the peripheral portions of the frame component. The light source may also include an UV transparent compression plate 78 which is brought into engagement with the upper surface of the section 30 of the diaphragm web during the bonding process.

Once the diaphragm section 30 has been bonded to the frame component, the section 30 is severed from the diaphragm web 10 by an appropriate cutting mechanism. As shown in FIG. 2, the cutting mechanism may be incorporated into the support 66 for the frame component. As opposed to incorporating the cutting mechanism into the frame support, a separate cutter may be provided, as shown at 79 in FIG. 8. In FIG. 2, the support member includes upstanding cutting edges 80 which extend about the periphery thereof. As the support member is pressed against the lower surface of the diaphragm web, the cutting edges 80 will sever the section 30 from the diaphragm material.

Following bonding and severing of the diaphragm section, the frame support 66 is lowered and new frame component is placed on the support. Although not shown in the drawing figures it is possible that a plurality of supports 66 may be mounted to appropriate lift cylinders or actuators so as to be simultaneously moved relative to the diaphragm web material 10. In these embodiments, a plurality of sections 30 are simultaneously applied to a plurality of frame components utilizing the same procedures as discussed above with respect to the single frame support shown in the drawing figures.

As previously mentioned, the manner in which the tension is applied to the web material within the applicator station 44 may vary. With specific reference to FIG. 4, a first embodiment for applying substantially transverse tension relative to the diaphragm web is shown in greater detail. In this embodiment, the tensioning device 65*a* includes opposite pairs of upper and lower elongated clamps or gripper members 82 and 83. The opposing grippers 82 and 83 are each carried on a frame moveable by a pneumatic or hydraulic actuator 85 which moves the grippers into aligned relationship on opposite sides of each of the edges 16 and 17 of the diaphragm web 10. Once aligned, the opposing grippers are urged together by activation of pinch cylinders 86 so that the opposite edges of the web material are engaged between gripper members. Thereafter, the actuators 85 are activated to stretch the web material outwardly relative to the elongated axis A—A thereof to apply a predetermined amount of tension to the web material transversely to the longitudinal axis. Once the web material is properly tensioned, the underlying frame component is engaged with the lower surface of the diaphragm as previously discussed and the section 30 of the diaphragm material bonded to the frame component. After the section 30 has been bonded to the frame component and the section severed from the web, the gripper members are released, allowing the diaphragm web material to be indexed by the take-up roller.

Figure 4:
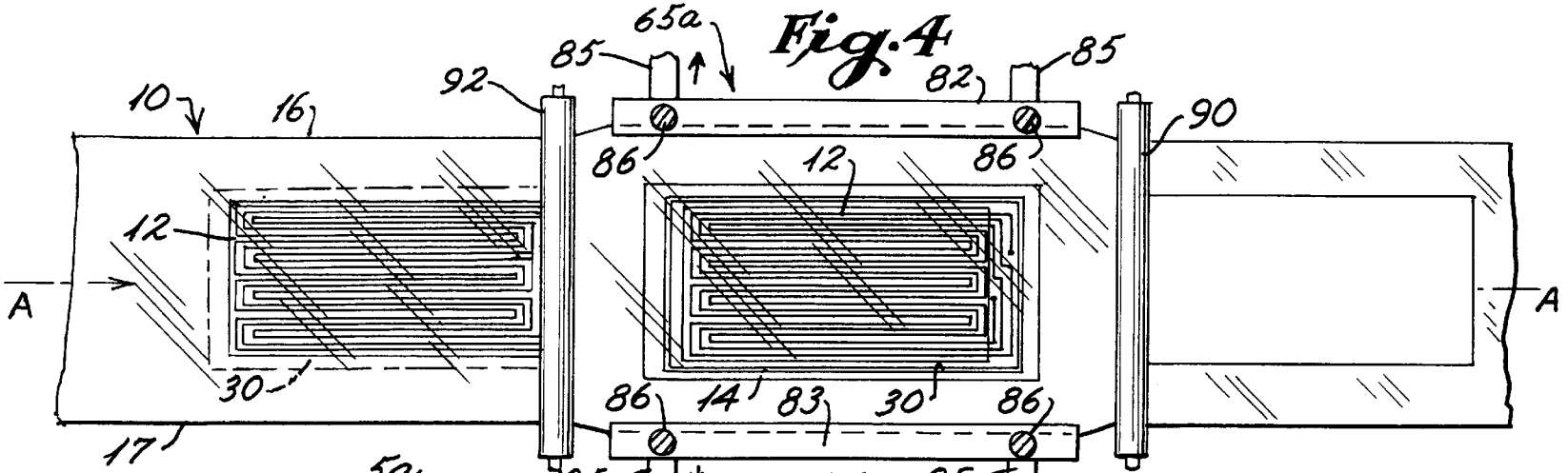
FIG. 4 is a top plan view of a first embodiment of a transverse tensioning assembly utilized in accordance with the present invention.

Also shown at FIG. 4 are optional members for applying a final axial tension along the elongated axis A—A of the web material within the applicator station 44. As shown, a pair of opposing pinch rollers 90 are provided which engage the upper and lower surfaces of the web material adjacent the exit or downstream end of the applicator station 44. Optional pinch bars or clamps 92 are mounted at the inlet side of the applicator station and serve to grasp the web material across its width. With this structure, with the clamps 92 retaining the material, the pinch rollers may be activated to supply a desired degree of tension along the axis of the material within the applicator station.

Figure 5:
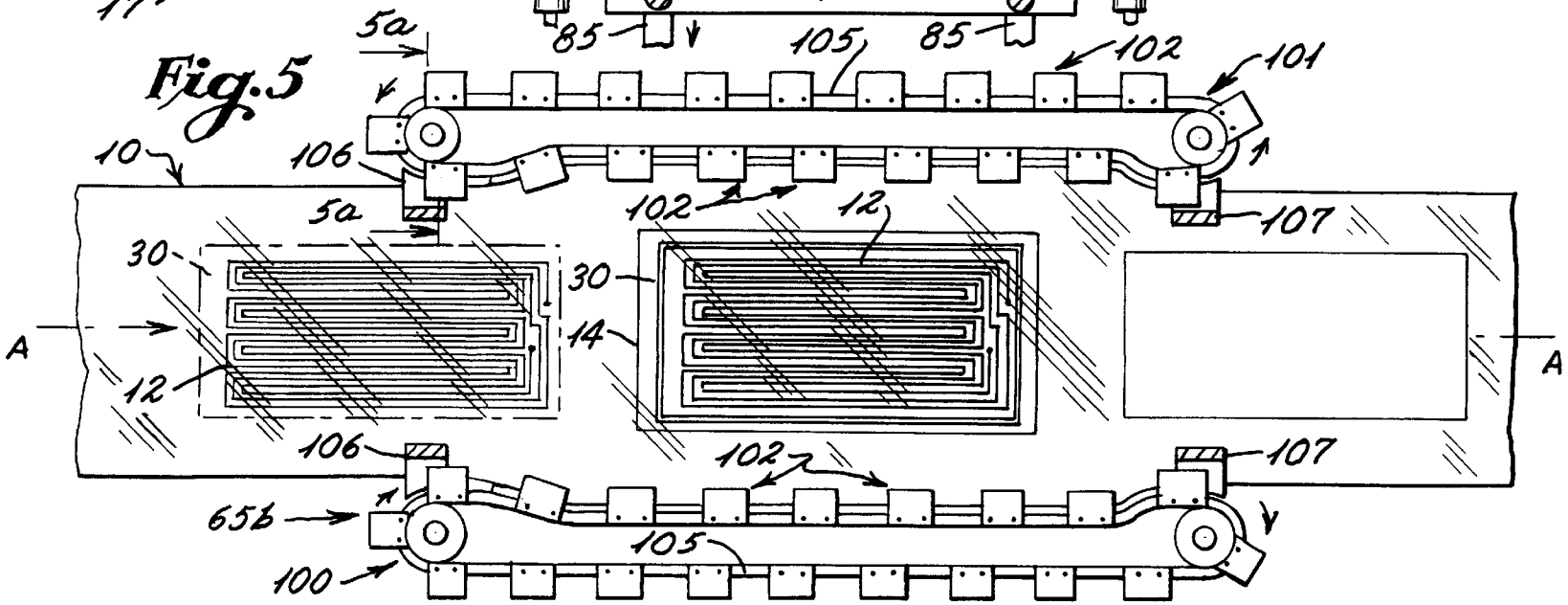
FIG. 5 is a top plan view of a variation of the first embodiment of transverse tensioning assembly utilized in accordance with the present invention.
Figure 5A:
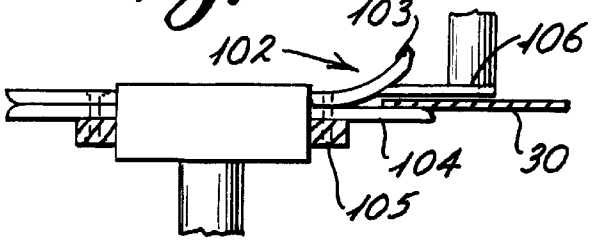
FIG. 5*a* is an enlarged cross-sectional view taken along line 5*a*—5*a* of FIG. 5.

With reference to FIGS. 5 and 5*a*, another variation of tensioning mechanism 65*b* is disclosed. In this variation, tensioning is provided by a tenter assembly consisting of a pair of generally opposing continuous conveyor mechanisms 100 and 101 to which a plurality of spaced gripping elements 102 are mounted so as to be in guided relationship with respect to the opposite side edges 16 and 17 of the web of diaphragm material as the web enters the applicator station 44. Each gripper element 102 consists of opposing clamping fingers 103 and 104, as shown in FIG. 5*a*, which are carried by a conveyor chain 105 or similar carrier element associated with the continuous conveyors 100 and 101. Each of the continuous conveyors 100 and 101 are driven by a motor assembly (not shown) so that the gripping elements 102 associated with each move at the same rate with respect to one another. As the web of diaphragm material approaches the applicator station 44, the opposing side edges thereof are successively engaged by the opposing gripping fingers 103 and 104 of the gripper elements 102, as shown on the left side of FIG. 5. The fingers are deflected by an appropriate separating mechanism 106 mounted slightly above the web of diaphragm material which acts to open the upper finger element 103 with respect to the lower element 104. Thereafter, the upper finger element is resiliently urged to clamp the web of diaphragm material against the opposing finger element 104. As each conveyor continues to be driven as the section 30 of diaphragm material enters the applicator station, the gripper elements 102 will follow the track (path) of the conveyor chain which diverges outwardly with respect to the elongated central axis A—A of the web of diaphragm material. In this manner, when the section 30 of diaphragm material is positioned centrally within the applicator station, the gripper elements will have pulled the web of diaphragm material transversely outwardly, thereby placing proper tension on the diaphragm section within the applicator station, as shown in FIG. 5. At this point, the conveyors may be stopped until a frame component is securely bonded to an aligned section of the diaphragm material and the section severed from the elongated web of diaphragm material. As the web of diaphragm material is indexed forwardly toward the take-up reel, the gripper elements 102 will pass between a separator element 107 mounted along the exit portion of the applicator station 44. The element 107 functions to separate the gripping finger 103 relative to the gripping finger 104, thereby releasing the edge of diaphragm material from the gripper elements 102. Although the embodiment shown in the drawing figures shows both of the continuous conveyors 100 and 101 diverging outwardly relative to the elongated central axis of the web of diaphragm material, in some embodiments, only one of the conveyors need diverge with respect to the other conveyor. Further, the process described may be done continuously as opposed to intermittently.

Figure 7:
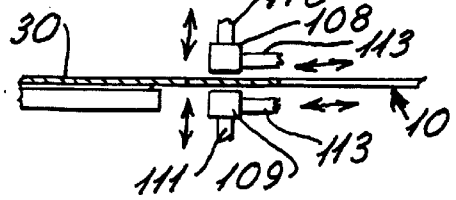
FIG. 7 is a cross-sectional view taken along line 7—7 of FIG. 6.

In FIGS. 6 and 7, another variation 65*c* of the tensioning mechanism 65*a* is disclosed. In this variation, a plurality of opposing gripping or clamping members 108 and 109 are mounted to be moveable into engagement on opposite faces of the web of diaphragm material by way of pinch cylinders (not shown) having extension rods 110 and 111. The gripping members are further mounted for horizontal movement to pneumatic or hydraulic cylinders 112 having extension rods 113 associated therewith. As shown in FIG. 6, a plurality of opposing pairs of the gripping or clamping members 108 and 109 are designed to engage the web of diaphragm material 10 in surrounding relationship with respect to a section 30 of the diaphragm material. Thereafter, by clamping the diaphragm material between the opposing clamping members and controlling the movement of the extension rods 113, multi-directional tensioning may be applied as shown by the arrows in the drawing figure. The particular orientation and the number of opposing gripping members may be varied depending upon the type of tension to be applied to the section of the web of diaphragm material.

Figure 8:
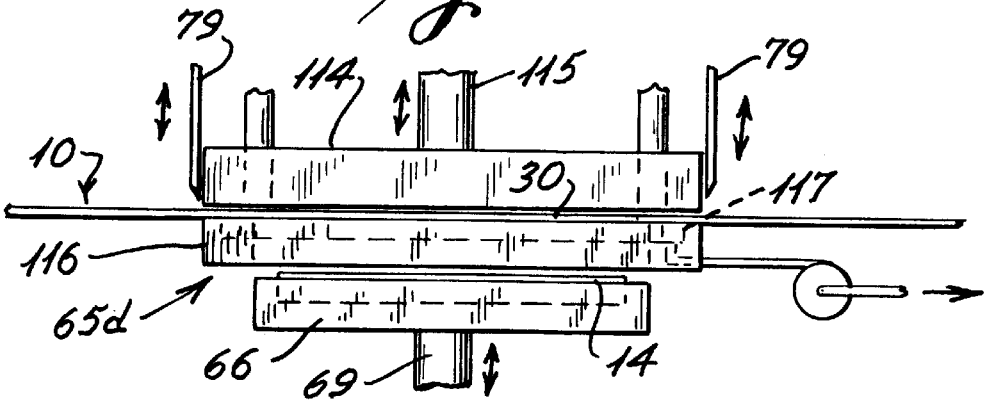
FIG. 8 is a side elevational view of a vacuum tensioning assembly utilized to obtain multi-directional tensioning of a diaphragm section being applied to a frame component.
Figure 9:
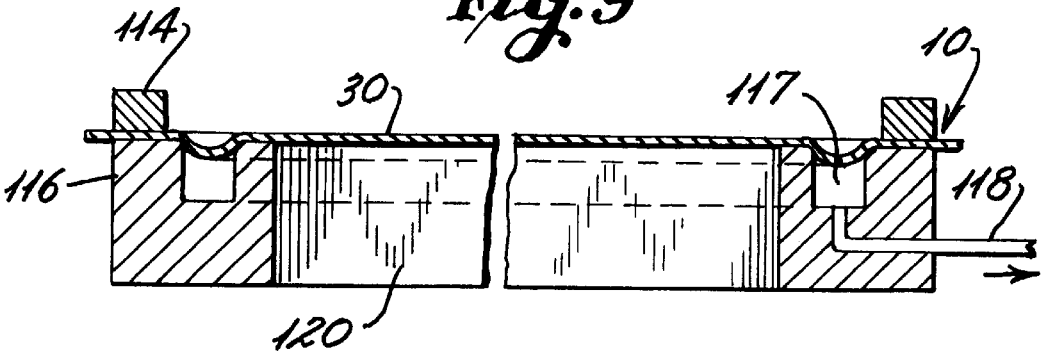
FIG. 9 is a cross-sectional illustrational view illustrating the tensioning of a diaphragm section relative to the vacuum clamping member shown in FIG. 6.
Figure 10:
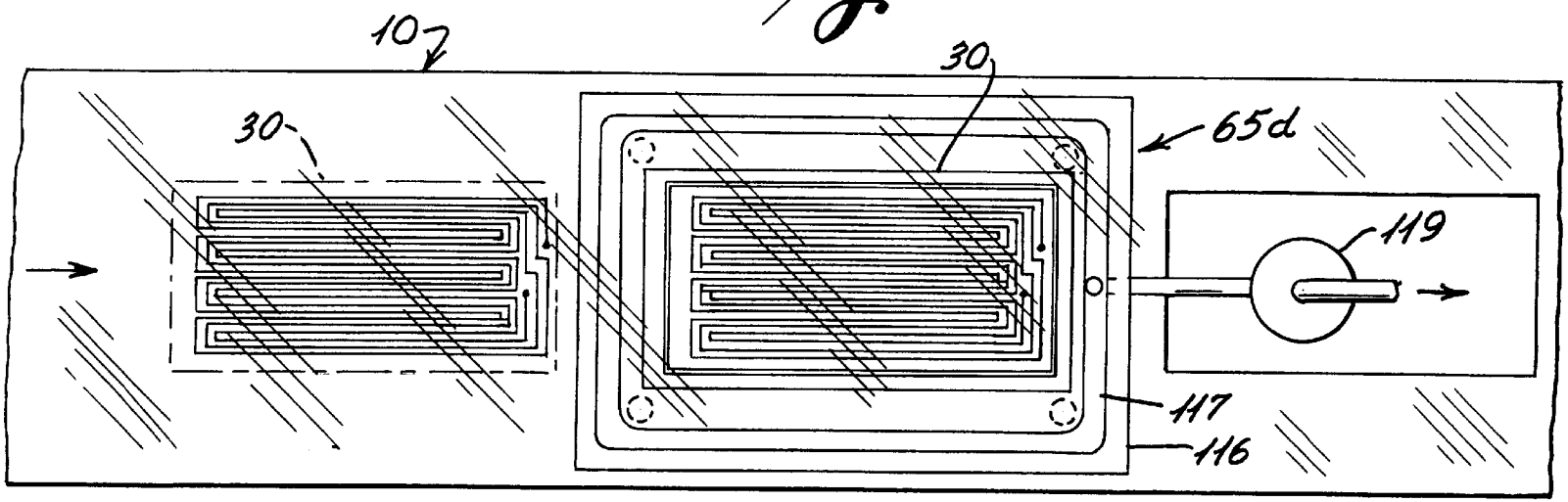
FIG. 10 is a top plan view of the vacuum clamp member of the embodiment of FIG. 6.

With particular reference to FIGS. 8–10, another tensioning mechanism 65*d* is disclosed in greater detail. In this embodiment, tensioning is provided by use of a vacuum frame which includes an upper open frame clamping element 114 mounted to a vertical actuator 115 which may be in the form of a pneumatic or hydraulic cylinder. The upper frame clamping member 114 cooperates with an opposing frame element 116 which has a greater cross-sectional configuration when compared with the upper clamping element, as shown in FIG. 9. A continuous vacuum channel 117 is formed in the frame element 116. The vacuum channel 117 includes one or more outlet ports 118 which are connected by appropriate conduits to a vacuum source such as a vacuum pump 119, as shown in FIG. 8. The upper clamping frame 114 is designed to engage the web of diaphragm material in surrounding relationship with respect to the vacuum channel 117 and forces the material against the lower outer portion of the frame element 116. An opening 120 defined by the lower frame element is of a size to permit a frame component 14 carried by the support 66 to be positioned therein so as to engage the lower surface of a section 30 of the diaphragm material, as illustrated in FIG. 8.

Utilizing this tensioning apparatus, once the web of diaphragm material has been appropriately aligned within the applicator station 44, the opposing frame elements 114 and 116 are engaged with one another. Thereafter, a vacuum is applied through the outlet ports 118 from the vacuum channel 117 of the lower frame element. The reduced pressure in the channel causes atmospheric pressure to force the edges of the diaphragm into the channel, as illustrated in FIG. 9, thereby placing the proper tension on the section of the diaphragm material which extends across the opening 120 of the lower frame element 116. Once proper tension has been applied, the support 66 for the frame component is elevated as previously discussed so as to engage the lower surface of the diaphragm material. Thereafter, the UV transparent plate 78 is positioned across the upper surface of the section of diaphragm material and the UV light source activated to cure the adhesive.

In this embodiment, it is possible to apply multi-directional tensioning to the diaphragm section 30 before it is secured to the frame component. By configuring the channel 117 appropriately, tension may be applied both axially and transversely as well as at other angles with respect to the web material to obtain the predetermined tensioning which is desired. In addition to different tension directions, the tensioning forces may be varied in any direction.

Figure 12:
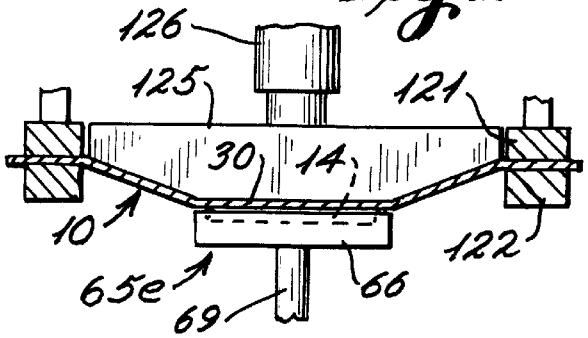
FIG. 12 is a view of the apparatus of FIG. 9 showing the frame support member being raised to engage a frame component against a pre-tensioned diaphragm section.
Figure 11:
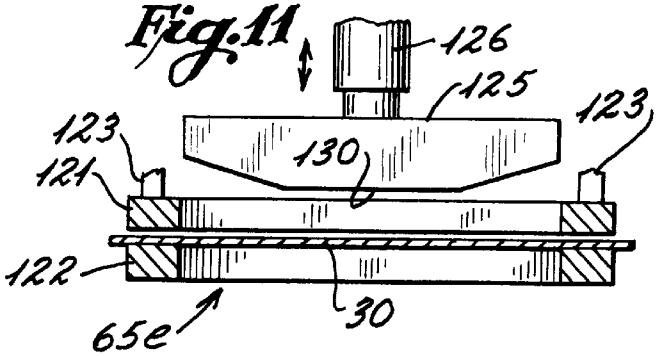
FIG. 11 is a cross-sectional of a further mechanical tensioning device utilized in accordance with the present invention.

With particular reference to FIGS. 11 and 13, a further embodiment 65*e* for mechanically tensioning a section 30 of the diaphragm material is disclosed. In this embodiment, a pair of opposing open frame clamps 121 and 122 are provided which engage the upper and lower surfaces of the web material 10 in surrounding relationship with respect to a section 30 having the electrical conductor pattern applied thereto. The frame clamps are mounted to appropriate pneumatic or hydraulic cylinders 123 which are actuated to move the clamps relatively toward and away from one another. Once the material is appropriately grasped between the opposing clamps, a tensioning shoe 125 is lowered by a pneumatic or hydraulic actuator 126 into engagement with the upper surface of the web material. The web material is thereby stretched as illustrated in FIG. 12 until proper tensioning of the diaphragm is obtained. Thereafter, the frame component carried by the support 66 is elevated into contact with the opposite surface of the section 30 and the diaphragm material bonded as previously discussed to the frame component. In some instances, the diaphragm material may be moved relative to the support 66 to thereby engage the material with a frame component.

As shown in the drawing figures, the peripheral edges of the tensioning shoe are tapered away from a generally planar central portion. The planar central portion 130 is of a configuration to substantially engage the entire area of the diaphragm section 30 during the tensioning process. The lower surface of the tensioning shoe which engages the diaphragm material may be coated with a low friction material to prevent binding of the material relative to the shoe when tension is being applied to the material.

As with the vacuum tensioning of the diaphragm, the tensioning utilizing the mechanical shoe allows multi-directional tensioning of the diaphragm relative to the frame component. By appropriately shaping and configuring the surface of the tensioning shoe, tension may be applied in substantially any direction relative to the elongated axis of the web material.

The method and apparatuses discussed above may also be used in the assembly of electrostatic transducers wherein the diaphragm material is coated with an electrically conductive coating. In such embodiments, it is not necessary to align the conductive coating on the web of diaphragm material as previously discussed with respect to the circuit patterns 12 as the web may be continuously coated. The coated web of diaphragm material need only be indexed into the applicator station and thereafter the diaphragm material bonded by one of the procedures set forth above, afterwhich the diaphragm material is severed.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

We claim:

1. A method of applying electrical circuit carrying diaphragms used in planar acoustic transducers to diaphragm supporting frame components wherein electrical circuits are applied in spaced relationship to an elongated web of diaphragm material to thereby define spaced diaphragm sections each having an electrical circuit with the web of diaphragm material being defined by elongated side edges and a central axis, the method comprising:

conveying the web of diaphragm material to a diaphragm applicator station and aligning a diaphragm section relative to a frame component and applying a predetermined tension to the aligned diaphragm section of the web of diaphragm material and thereafter securing the tensioned diaphragm section to the frame component and severing the secured diaphragm section from the web of diaphragm material to thereby maintain the secured diaphragm section in a predetermined tension with respect to the frame component.

2. The method of claim 1 wherein the predetermined tension is applied to the diaphragm section by clamping the web of diaphragm material adjacent the side edges and thereafter applying a force to urge the side edges of said diaphragm material outwardly relative to one another.

3. The method of claim 2 including applying axial tension generally parallel to the elongated axis of the web material as the web of diaphragm material is conveyed to the diaphragm applicator station.

4. The method of claim 2 including applying axial tension to the diaphragm section which is generally parallel to the central axis of the web of diaphragm material prior to securing the tensioned diaphragm section to the frame component.

5. The method of claim 2 wherein the tensioned diaphragm section is secured to the frame component by applying an adhesive to the frame component and subsequently applying pressure to the frame component to engage the tensioned diaphragm section until the adhesive bonds the tensioned diaphragm section to the frame component.

6. The method of claim 5 including the additional step of applying an ultraviolet (UV) light source to cure the adhesive applied to the frame component after force is applied to engage the frame component against the tensioned diaphragm section.

7. The method of claim 1 wherein the pre-determined tension is applied to the diaphragm section by engaging the web of diaphragm material at a plurality of locations relative to the diaphragm section and thereafter applying the predetermined tension to the diaphragm section.

8. The method of claim 7 wherein the tensioned diaphragm section is secured to the frame component by applying an adhesive to the frame component and subsequently applying pressure to the frame component to engage the tensioned diaphragm section until the adhesive bonds the tensioned diaphragm section to the frame component.

9. The method of claim 1 in which the predetermined tension is applied to the section of diaphragm material by engaging the web of diaphragm material between opposing clamping elements in surrounding relationship with respect to the aligned diaphragm section and thereafter applying a vacuum to a portion of the web of diaphragm material adjacent to the aligned diaphragm section to thereby tension the diaphragm section.

10. The method of claim 9 wherein the predetermined tension is applied in multiple directions relative to the central axis of the web of diaphragm material.

11. The method of claim 9 including applying axial tension generally parallel to the elongated axis of the web material as the web of diaphragm material is conveyed to the diaphragm applicator station.

12. The method of claim 9 wherein the tensioned diaphragm section is secured to the frame component by applying an adhesive to the frame component and subsequently applying pressure to the frame component to engage the tensioned diaphragm section until the adhesive bonds the tensioned diaphragm section to the frame component.

13. The method of claim 12 including the additional step of applying an ultraviolet (UV) light source to cure the adhesive applied to the frame component after force is applied to engage the frame component against the tensioned diaphragm section.

14. The method of claim 1 in which the predetermined tension to the aligned section of diaphragm material is applied by engaging the web of diaphragm material between frame clamps surrounding the aligned diaphragm section and thereafter applying a force generally perpendicularly to a surface of the aligned diaphragm section between the frame clamps.

15. The method of claim 14 wherein the predetermined tension is applied in multiple directions relative to the central axis of the web of diaphragm material.

16. The method of claim 14 including applying axial tension generally parallel to the elongated axis of the web material as the web of diaphragm material is conveyed to the diaphragm applicator station.

17. The method of claim 14 wherein the tensioned diaphragm section is secured to the frame component by applying an adhesive to the frame component and subsequently applying pressure to the frame component to engage the tensioned diaphragm section as the adhesive bonds the tensioned diaphragm section to the frame component.

18. The method of claim 17 including using an ultraviolet (UV) light source to cure the adhesive applied to the frame component after force is applied to engage the frame component against the tensioned diaphragm section.

19. The method of claim 1 wherein the predetermined tension is applied in multiple directions relative to the central axis of the web of diaphragm material.

20. The method of claim 1 wherein the relative alignment of a diaphragm section and a frame component includes detecting the position of the web of diaphragm material utilizing at least one sensor.

21. The method of claim 1 including rolling the web of diaphragm material having electrical conductor circuits applied thereto into a roll prior to conveying the web of diaphragm material to the diaphragm applicator station.

22. A method of applying electrical circuit carrying diaphragms used in planar acoustic transducers to diaphragm supporting frame components, the method comprising:

a) providing an elongated web of the diaphragm material wherein the web has elongated side edges and an elongated central axis;

b) forming a plurality of electrical conductor circuits in spaced relationship on the web of diaphragm material so as to define a plurality of diaphragm sections each having an electrical conductor circuit;

c) conveying the web of diaphragm material to a diaphragm applicator station and aligning a diaphragm section with a frame component and applying a predetermined tension to the diaphragm section relative to at least one direction with respect to the central axis of the web of diaphragm material; and thereafter d) securing the tensioned diaphragm section to the frame component and severing the secured diaphragm section from the web of diaphragm material to thereby maintain the secured diaphragm section in predetermined tension with respect to the frame component.

23. The method of claim 22 wherein the pre-determined tension is applied at least transversely with respect to the central axis of the web of diaphragm material.

24. The method of claim 22 wherein the predetermined tension is applied in multiple directions relative to the central axis of the web of diaphragm material.

25. An apparatus for applying electrical circuit carrying diaphragms used in planar acoustic transducers to diaphragm supporting frame components wherein the electrical circuits are applied in spaced relationship to an elongated web of diaphragm material such that the web of diaphragm material defines a plurality of diaphragm sections, each having an electrical circuit applied thereto, the apparatus comprising:

means for conveying the web of diaphragm material from a feed station to a collection station, applicator means disposed between the feed station and the collection station through which the web of diaphragm material passes, said applicator means including first means for tensioning the diaphragm section in at least one direction with respect to an elongated axis of the web of diaphragm material, means for supporting at least one frame component and for engaging said at least one frame component with a diaphragm section of the web of diaphragm material being retained under tension by said means for tensioning and being adapted to retain pressure between the diaphragm section and the frame component until a bond is created therebetween to secure the diaphragm section to the frame component, and means for severing the diaphragm section from the web of diaphragm material.

26. The apparatus of claim 25 in which said first means for tensioning includes at least two pairs of opposing gripping members, actuator means for urging each of said opposing gripping members to grip the web of diaphragm material, and means for urging said at least two pairs of opposing gripping members outwardly relative to one another to thereby tension the diaphragm section.

27. The apparatus of claim 26 in which said first means for tensioning includes a tenter mechanism having at least one continuous assembly of a plurality of spaced opposing gripping members which are adapted to engage the web of diaphragm material therebetween, and means for conveying said plurality of spaced opposing gripping members longitudinally and transversely with respect to the elongated axis of the web of diaphragm material to thereby tension the diaphragm section at least transversely with respect to the elongated axis thereof.

28. The apparatus of claim 26 in which said first means for tensioning includes means adapted to applying a vacuum to a surface portion of the web of diaphragm material generally surrounding a diaphragm section of the web of diaphragm material.

29. The apparatus of claim 28 wherein said means adapted to applying a vacuum includes a pair of opposing frame elements of a size to engage the web of diaphragm material in surrounding relationship with respect to one of the diaphragm sections, a channel formed in one of said opposing frame elements, a vacuum source connected to said channel in said one of said opposing frame elements for applying a vacuum along said channel so as to draw a portion of the web of diaphragm material into said channel to thereby apply tension to the diaphragm section.

30. The apparatus of claim 26 in which said first means for tensioning includes a pair of opposing frame clamps defining an open area therein, said clamps being adapted to surround one of the diaphragm sections of the web of diaphragm material, and deforming means engageable with the diaphragm section of the web of diaphragm material in the open area of the frame clamps to thereby place tension on the diaphragm section surrounded by the opposing frame clamps.

31. The apparatus of claim 26 including means for urging said means for supporting at least one frame component support toward a diaphragm section.

32. The apparatus of claim 26 including means intermediate said feeding and said collection stations for applying tension generally axially in parallel alignment with an elongated central axis to the web of diaphragm material.

33. The apparatus of claim 32 in which said means for applying axial tension includes first gripper means mounted adjacent an inlet to the applicator means and a second member for applying axial tension adjacent an exit end of the applicator means.

34. The apparatus of claim 26 including means for aligning a section of the web of diaphragm material relative to the applicator means.

35. A method of applying electrically conductive coated diaphragms used in electrostatic acoustic transducers to diaphragm supporting frame components wherein the conductive coating is applied to an elongated web of diaphragm material to thereby define a substantially continuously coated web of diaphragm material with the web of diaphragm material being defined by elongated side edges and a central axis, the method comprising:

conveying the web of diaphragm material to a diaphragm applicator station and positioning the web relative to a frame component and applying a predetermined tension to the web of diaphragm material and thereafter securing a tensioned section of the web to the frame component and severing the secured section from the web of diaphragm material to thereby maintain the secured diaphragm section in a predetermined tension with respect to the frame component.

36. An apparatus for applying electrically conductive coated diaphragms used in electrostatic acoustic transducers to diaphragm supporting frame components wherein the conductive coating is applied to an elongated web of diaphragm material such that the web of diaphragm material defines a substantially continuous coated web of diaphragm material, the apparatus comprising:

means for conveying the web of diaphragm material from a feed station to a collection station, applicator means disposed between the feed station and the collection station through which the web of diaphragm material passes, said applicator means including first means for tensioning the diaphragm section in at least one direction with respect to an elongated axis of the web of diaphragm material, means for supporting at least one frame component and for engaging said at least one frame component with a section of the web of diaphragm material being retained under tension by said means for tensioning and being adapted to retain pressure between the section and the frame component until a bond is created therebetween to secure the section to the frame component, and means for severing the section from the web of diaphragm material.

* * * * *